US009423198B1

(12) United States Patent
Oliver

(10) Patent No.: US 9,423,198 B1
(45) Date of Patent: Aug. 23, 2016

(54) FLASH HIDER WITH GAS FLOW CONTROL MODULES AND ASSOCIATED METHODS

(71) Applicant: Russell Oliver, Draper, UT (US)

(72) Inventor: Russell Oliver, Draper, UT (US)

(73) Assignee: OSS Suppressors LLC, Murray, UT (US)

( * ) Notice: Subject to any disclaimer, the term of this patent is extended or adjusted under 35 U.S.C. 154(b) by 0 days.

(21) Appl. No.: 14/517,558

(22) Filed: Oct. 17, 2014

Related U.S. Application Data

(60) Provisional application No. 61/892,248, filed on Oct. 17, 2013.

(51) Int. Cl.
*F41A 21/34* (2006.01)

(52) U.S. Cl.
CPC ..... *F41A 21/34* (2013.01)

(58) Field of Classification Search
CPC ..... F41A 21/34; F41A 21/30; F41A 21/36
USPC ..... 89/14.2, 14.3, 14.4; 181/223; D22/108
See application file for complete search history.

(56) References Cited

U.S. PATENT DOCUMENTS

| | | | | | |
|---|---|---|---|---|---|
| 748,157 | A | * | 12/1903 | Bouton | F01N 1/084 181/265 |
| 822,127 | A | * | 5/1906 | HUfnagel | F16L 55/02781 181/239 |
| 916,885 | A | * | 3/1909 | Maxim | F41A 21/30 181/223 |
| 1,341,363 | A | * | 5/1920 | Fiala | F41A 21/30 181/223 |
| 1,427,802 | A | * | 9/1922 | Goodwin | F41A 21/30 181/223 |
| 1,462,158 | A | * | 7/1923 | Wildner | F41A 21/30 181/223 |
| 1,736,319 | A | * | 11/1929 | Maxim | F01N 1/06 181/267 |
| 1,773,443 | A | * | 8/1930 | Wilman | C09B 49/10 89/14.4 |
| 2,514,996 | A | * | 7/1950 | Faust, Jr. | F41A 21/30 181/223 |
| 743,111 | A | | 1/1956 | Oliver | |
| 3,455,203 | A | * | 7/1969 | Pillersdorf | F41A 21/34 181/223 |

(Continued)

FOREIGN PATENT DOCUMENTS

| | | |
|---|---|---|
| GB | 743111 | 11/1956 |

OTHER PUBLICATIONS

Wikipedia, "Suppressor", http://en.wikipedia.org/wiki/Suppressor, retrieved Jan. 26, 2010, pp. 1-14.

*Primary Examiner* — Troy Chambers
*Assistant Examiner* — Bridget Cochran
(74) *Attorney, Agent, or Firm* — Thorpe North & Western, LLP

(57) ABSTRACT

A firearm flash hider can include a base module and at least one vented flash control module. The base module can have a longitudinal boreline which is fluidly coupleable to a muzzle end of a firearm to allow a projectile to pass therethrough. The base module can also have an inlet port which is operable to receive at least a portion of a flash generated by firing the projectile. The vented flash control module can be arranged along the longitudinal boreline distal to the muzzle end. The vented flash control module can also have a flash chamber bounded by at least one wall that at least partially defines a geometry of the flash chamber and extends both radially and longitudinally from the boreline and translates circumferentially as it extends longitudinally. The flash chamber terminates at a circumferential angle of rotation from the inlet port where the circumferential angle of rotation being less than 180 degrees. The flash hider can typically have from one to four vented flash control modules oriented in series.

15 Claims, 5 Drawing Sheets

(56) References Cited

U.S. PATENT DOCUMENTS

| | | | | | |
|---|---|---|---|---|---|
| 3,667,570 | A * | 6/1972 | WerBell, III | F41A 21/30 | 181/223 |
| 3,693,750 | A * | 9/1972 | Takkunen | E04B 1/86 | 181/286 |
| 4,454,798 | A * | 6/1984 | Shea | F41A 21/30 | 181/223 |
| 4,482,027 | A * | 11/1984 | Gould | F41J 13/00 | 181/223 |
| 4,501,189 | A * | 2/1985 | Brandl | F41A 21/30 | 181/223 |
| 4,510,843 | A * | 4/1985 | Rabatin | F41A 21/325 | 89/14.4 |
| 4,530,417 | A * | 7/1985 | Daniel | F41A 21/30 | 181/223 |
| 4,576,083 | A * | 3/1986 | Seberger, Jr. | F01N 1/08 | 181/223 |
| 4,907,488 | A * | 3/1990 | Seberger | F41A 21/30 | 181/223 |
| 4,974,489 | A | 12/1990 | Fishbaugh | | |
| 5,010,676 | A | 4/1991 | Kennedy | | |
| 5,029,512 | A | 7/1991 | Latka | | |
| 5,036,747 | A | 8/1991 | McClain, III | | |
| 5,078,043 | A | 1/1992 | Stephens | | |
| 5,164,535 | A | 11/1992 | Leasure | | |
| 5,590,484 | A | 1/1997 | Mooney et al. | | |
| 5,661,255 | A | 8/1997 | Webb, III | | |
| 5,679,916 | A | 10/1997 | Weichert | | |
| D415,813 | S | 10/1999 | O'Quinn et al. | | |
| 6,079,311 | A | 6/2000 | O'Quinn et al. | | |
| 6,302,009 | B1 | 10/2001 | O'Quinn et al. | | |
| 6,425,310 | B1 | 7/2002 | Champion | | |
| 6,575,074 | B1 | 6/2003 | Gaddini | | |
| 6,796,214 | B2 | 9/2004 | Hausken et al. | | |
| 7,000,547 | B2 | 2/2006 | Amick | | |
| 7,059,233 | B2 | 6/2006 | Amick | | |
| 7,131,228 | B2 | 11/2006 | Hochstrate et al. | | |
| 7,207,258 | B1 | 4/2007 | Scanlon | | |
| 7,237,467 | B1 | 7/2007 | Melton | | |
| 7,308,967 | B1 | 12/2007 | Hoel | | |
| 7,325,474 | B2 | 2/2008 | Yoshimura et al. | | |
| 7,412,917 | B2 | 8/2008 | Vais | | |
| 7,870,815 | B2 * | 1/2011 | Hung | F41A 21/34 | 42/77 |
| 7,874,238 | B2 | 1/2011 | Silvers | | |
| 8,042,448 | B1 | 10/2011 | Sylvester et al. | | |
| 8,087,337 | B1 | 1/2012 | Cary | | |
| 8,096,222 | B2 | 1/2012 | Silvers | | |
| D657,012 | S | 4/2012 | Woodell | | |
| 8,453,789 | B1 | 6/2013 | Honigmann et al. | | |
| 8,516,941 | B1 * | 8/2013 | Oliver | F41A 21/30 | 181/223 |
| 8,695,474 | B2 * | 4/2014 | Overbeek Bloem | F41A 21/325 | 89/14.2 |
| D712,997 | S | 9/2014 | Proske | | |
| D722,670 | S | 2/2015 | Oliver | | |
| D723,647 | S | 3/2015 | Oliver | | |
| 8,978,818 | B2 | 3/2015 | Proske | | |
| 2010/0126334 | A1 | 5/2010 | Shults et al. | | |
| 2012/0048100 | A1 | 3/2012 | Davies | | |
| 2013/0168181 | A1 | 7/2013 | Wirth et al. | | |
| 2013/0180150 | A1 | 7/2013 | Dueck | | |
| 2014/0231168 | A1 | 8/2014 | Dueck | | |
| 2014/0262605 | A1 | 9/2014 | Washburn et al. | | |
| 2015/0001002 | A1 | 1/2015 | Wirth et al. | | |

* cited by examiner

FLASH HIDER WITH GAS FLOW CONTROL MODULES AND ASSOCIATED METHODS

RELATED APPLICATIONS

This application claims priority to U.S. Provisional Application No. 61/892,248, filed Oct. 17, 2013 which is incorporated herein by reference.

BACKGROUND

Discharging a firearm causes gases to be produced through rapid, confined burning of a propellant that accelerates a projectile. This typically generates a loud noise, a muzzle flash of light, and sometimes visible gas discharge. Often, it is desirable to reduce the amount of noise and light produced by discharging a firearm. For example, military snipers or special operations forces personnel may require stealth to successfully complete missions. Suppressors, or silencers, are typically connected to the muzzle end of a firearm to temporarily capture gas that exits the muzzle. Some suppressor designs divert a portion of the discharge gas to a secondary chamber, such that the gas does not exit the suppressor by the same path as the projectile. The gas is released from the suppressor at a significantly reduced pressure. In general, the more gas a suppressor captures or redirects, the quieter the discharge sound of the firearm. Flash hiders operate in much the same way upon discharge of the firearm, dispersing ignited media thereby diffusing flash.

The presence of a suppressor and/or flash hider, however, may increase the back pressure of the gas in the barrel of the firearm. Increased back pressure in the barrel can influence the firearm's operation. For example, some firearms are gas-operated and use discharge gas pressure in the barrel to reload the firearm. Thus, increasing gas back pressure in the barrel can increase forces acting on the reloading components and affect their operation. Higher forces can also reduce the service life of the reloading components. For at least these reasons, accurately and predictably controlling the pressure attributes of firearm suppressors and flash hiders remains an active field of endeavor.

SUMMARY

Thus, there is a need for a firearm discharge gas flow control device that consistently and uniformly distributes gases generated during discharge of the weapon throughout the body of the suppressor.

Accordingly, a firearm discharge gas flow control device and associated methods are provided. In accordance with one aspect of the invention, a firearm discharge gas flow control module is provided that can be fluidly coupleable to a muzzle end of a firearm to allow a projectile to pass therethrough. The gas flow control module can include an inlet port, operable to receive at least a portion of a discharge gas generated by firing the projectile, and a gas chamber, bounded by at least one wall that at least partially defines a geometry of the gas chamber. The gas chamber can extend both radially and longitudinally from the inlet port and can translate circumferentially as the gas chamber extends longitudinally. The gas chamber can terminate at a circumferential angle of rotation from the inlet port: the circumferential angle of rotation can be less than 180 degrees.

Additionally, a firearms suppressor operable to be fluidly coupled to a muzzle end of a firearm can be provided. The suppressor can include a plurality of discharge gas flow control modules arranged in a longitudinal stack. Each of the modules can include at least two gas chambers arranged in a circumferentially offset orientation. Each gas chamber can be operable to receive a different portion of a discharge gas generated by firing the projectile. Each of the gas chambers can extend both radially and longitudinally from a bore of the suppressor and each of the gas chambers can translate circumferentially as it extends longitudinally.

In addition, a firearms flash hider operable to be fluidly coupled to a suppressor as well as operable to be fluidly coupled to a muzzle end of a firearm can be provided. The flash hider can be one continuous component designed to include a plurality of discharge flash control modules arranged longitudinally. Each of the modules can include at least two flash chambers arranged in a circumferentially offset orientation. Each flash chamber can be operable to receive a different portion of a discharge flash generated by ignition upon firing the projectile. Each of the flash chambers can extend both radially and longitudinally from a bore of the flash hider and each of the flash chambers can translate circumferentially as it extends longitudinally.

In one aspect of the invention, a method of controlling gas flow discharged from a firearm is provided. The method can include arranging one or more gas flow control modules on the end of a muzzle of a firearm, with each of the one or more modules including at least two gas chambers arranged in a circumferentially offset orientation. The firearm can be discharged to fire a projectile, thereby generating discharge gas, a portion of which is thereby routed through the gas chambers of the modules.

In another aspect of the invention, a method of controlling flash generated by ignition upon firearm discharge is provided. The method can include arranging one or more flash control modules on the end of a suppressor or muzzle of a firearm, with each of the one or more modules including at least two flash chambers arranged in a circumferentially offset orientation. The firearm can be discharged to fire a projectile, thereby causing ignition and generating flash, a portion of which is thereby routed through the flash chambers of the modules.

Figure 1A:
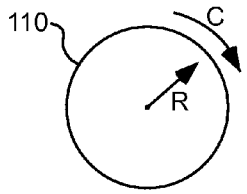
FIG. 1A is a geometric representation of radial and circumference directions, as those terms are used in the present discussion.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Reference will now be made to certain examples, and specific language will be used herein to describe the same. Examples discussed herein set forth a firearm discharge gas flow control device and associated methods that can modify flow of the gas discharged by firing a projectile from a firearm.

With the general embodiments set forth above, it is noted that when describing the firearm discharge gas flow control device, or the related method, each of these descriptions are considered applicable to the other, whether or not they are explicitly discussed in the context of that embodiment. For example, in discussing the various modules taught herein, the system and/or method embodiments are also included in such discussions, and vice versa.

Furthermore, various modifications and combinations can be derived from the present disclosure and illustrations, and as such, the following figures should not be considered limiting. It is noted that reference numerals in various figures will be shown in some cases that are not specifically discussed in that particular figure. Thus, discussion of any specific reference numeral in a given figure is applicable to the same reference numeral of related figures shown herein.

It is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "a gas chamber" can include one or more of such gas chambers.

Also, it is noted that various modifications and combinations can be derived from the present disclosure and illustrations, and as such, the following figures should not be considered limiting.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

As used herein the term "suppressor" can include any device that reduces the amount of noise and muzzle flash generated by firing a firearm.

As used herein the term "flash hider" can include any device that reduces the muzzle flash generated by firing a firearm.

Figure 1B:
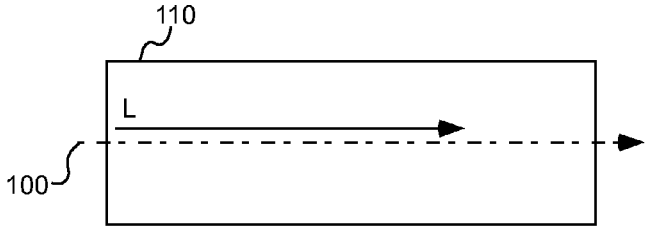
FIG. 1B is a geometric representation of longitudinal direction, as that term is used in the present discussion.

FIGS. 1A and 1B are presented to clarify the meanings of various directional terms, as those terms are used herein. Generally, one or more discharge gas flow control modules are arranged at the muzzle end of a firearm, aligned with a longitudinal axis along which a projectile will travel after being fired from the firearm. Such an axis is shown by example at 100 in FIG. 1B, relative to the schematically illustrated space 110. When the terms "longitudinal," or "longitudinally" are used herein, it is understood that the direction being referenced is parallel to the axis 100, shown by example at "L."

FIG. 1A is a schematic representation of radial and circumferential directions relative to exemplary shape 110 (the axis 100 would be extending into and out of the plane of FIG. 1A). When used herein, the terms "radial," or "radially," are understood to refer to the direction "R" illustrated, which is along any given radius extending outwardly from (or toward, as the case may be) the center of the space 110. When used herein, the term "circumferentially" is to be understood to refer to the direction shown by "C," which is along an arc about the center of the exemplary space 110. The term "circumferentially" can be in either direction (clockwise or counter-clockwise), and is not limited to travel along the actual circumference of the space being discussed, but can be closer or further from a center of such space than is the actual circumference.

Reference is made herein to the term "gas," often in connection with a discharge gas produce by discharging a firearm. It is to be understood that such reference includes not only the pure gas produced by such event, but can also include particulates and vapor carried by the gas. Thus, while the present components capture, redirect, suppress, etc., the gas produced by discharging a firearm, they can also be effectively utilized to manage the particulates and related components produced by such an event.

While neither a firearm nor a projectile is illustrated herein, the use of generalized suppression components with such devices is well known in the art. One of ordinary skill in the art, having possession of this disclosure, would readily understand how the present gas control systems are used with firearms and projectiles. Attachment of the present modules to the muzzle end of a firearm will also be readily understood by one of ordinary skill in the art having possession of this disclosure. For example, a stack of gas control modules 10, 10*a*, 10*b*, etc., is shown arranged within an outer cover 18 in FIG. 4. One of ordinary skill in the art would readily understand the use of such cover, including its attachment at the muzzle end of a firearm, and attachment of the cover around or about the modules 10, 10*a*, 10*b*, etc. (or attachment of the modules within the cover). Suitable attachment methods include, without limitation, threaded connections, bayonet connections, or any other suitable type of connection.

Turning now to FIGS. 2A through 2E, an exemplary firearm discharge gas flow control module 10 is illustrated in accordance with one embodiment of the invention. The flow control module 10 can generally include a series of gas chambers, examples of which are shown at 12, 14, etc. The module can include a hollow center region commonly known as a bore 16. The bore is aligned with the longitudinal bore of a firearm when the module is oriented at the end of a muzzle of the firearm, such that a projectile, when discharged by the firearm, travels through the bore of the firearm, then through the bore of the one or more gas control modules, then continues along its intended path. The act of discharging the projectile generally creates a substantial amount of discharge gas which, without the presence of any gas control modules, will also travel along the bore until it is released at the end of the bore with the projectile.

When the gas flow control module 10 is utilized at the muzzle end of a firearm, gas is diverted away from the bore 16 into gas chambers 12, 14, etc., to suppress the audible, visual and thermal signature of the projectile discharge event. Generally, the chambers can include an inlet port immediately adjacent the bore which allows gas to enter the chambers as the projectile passes through the bore. Inlet ports are shown by example at 17 and 20 in FIG. 2D. As discussed in more detail below, the present modules can include a variety of types of gas chambers, some of which are "closed" and some of which are "open." The inlet port 17 corresponds to the type of gas chamber shown at 12. The inlet port 20 corresponds to the type of gas chamber shown at 14.

Each gas chamber is bounded by at least one wall that at least partially defines a geometry of the gas chamber. In the example provided in FIG. 2C, the gas chambers 12 and 14 are bounded by wall 22 that at least partially defines the geometric space of the chambers 12 and 14. In this example, the geometry of gas chamber 14 is defined such that the gas chamber extends both radially and longitudinally from the inlet port 20, and translates circumferentially as the gas chamber extends longitudinally. In other words, discharge gas enters the gas chamber through the inlet port, and expands radially outwardly from that point, as well as longitudinally from that point. The gas chamber also forces the gas to expand circumferentially as the gas expands longitudinally. Thus, as best shown at 24 in FIG. 3A (where two modules are shown in a stacked arrangement), the chamber geometry can be viewed as a "cork-screw" geometry, in which the chamber extends from the inlet port and turns circumferentially as it extends longitudinally and radially.

This arrangement allows the gas chambers to transition discharge gas from a very high pressure level (at the bore, and thus the inlet port area) to lower pressure areas located at terminal ends of the gas chambers. Each chamber can rotate, or "twist," relative to its respective inlet port some predetermined amount. As shown in FIG. 2B, the distance a gas chamber twists or rotates circumferentially can be represented by an angle "β."

Generally, each module will include two or more gas chambers oriented within the same longitudinal space. That is, the two or more gas chambers are oriented circumferentially offset from one another, such that two or more chambers complete a 360 degree arrangement about the bore. Thus, in one embodiment, each gas chamber terminates at a circumferential angle of rotation "β" from the inlet port that is less than 180 degrees. This can be the case, for example, when only two chambers are utilized, as each will consume a circumferential space that is less than half the total circumferential space. In the example shown in FIGS. 2A through 2E, the module 10 actually includes six gas chambers, three each of type 12 and three each of type 14. In this aspect, each pair of chambers (a "pair" is one of type 12 and one of type 14) will consume about 120 degrees of circumferential space (about one-third of the overall 360 degrees).

As will be appreciated, while the number of chambers utilized in one module can vary, each module is still limited to a fixed longitudinal space (or length). Thus, the gas chambers of each module may be "stacked" circumferentially, but the module itself need not be increased in length if the number of chambers is increased. While the number of chambers can be varied, the number is typically at least two, and can be as many as ten (with two pairs of five chambers). Larger numbers of chambers are typically possible with suppressors used on larger caliber firearms, as such an increase in scale allows complex machining of the various inlet ports, chambers, walls, etc., necessary to form the module.

By arranging the gas chambers adjacent one another circumferentially, the forces applied to the muzzle (and thus the firearm generally) due to the back pressure created by the chambers can be better balanced, as the forces are distributed circumferentially about the bore. In addition, the total amount of discharge gas that enters any one module can be transitioned more quickly from a high pressure area (at the bore or inlet port) to the low pressure area (at the terminal portions of the chambers). If only one inlet port were used, for instance, the high pressure gas at that inlet port is restricted, or "choked," by the limited inlet port opening. By increasing the number of inlet ports, and the number of gas chambers extending therefrom, the discharge gas can be more quickly and more efficiently controlled. The present technology thus radially distributes the high pressures generated by the discharge of a projectile in a highly efficient manner. In addition, as numerous modules can be stacked longitudinally, the longitudinal efficiency of the overall system is greatly improved. Thus, the present system performs better than prior art systems, which include very high pressures near the muzzle of the gun, and lower pressures near the outlet of the suppressor. The present system more effectively distributes pressures radially outward from the bore, and longitudinally outward from the muzzle exit.

Figure 3A:
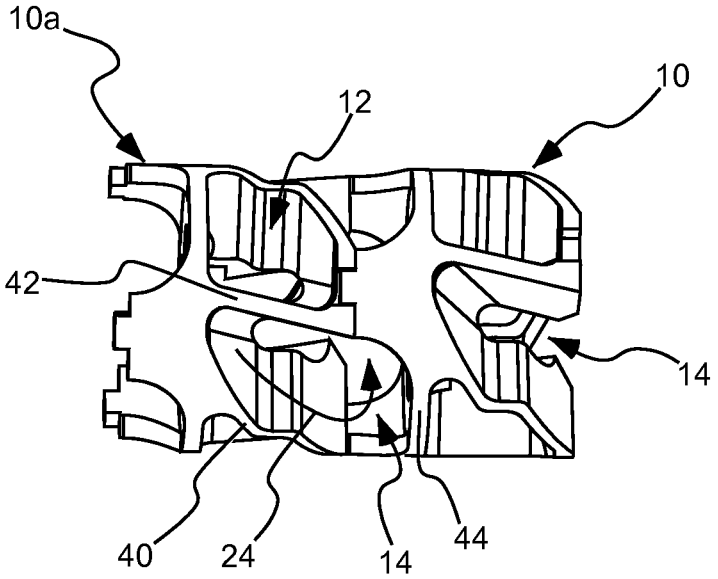
FIG. 3A is a side view of a pair of stacked modules in accordance with an embodiment of the invention.
Figure 3B:
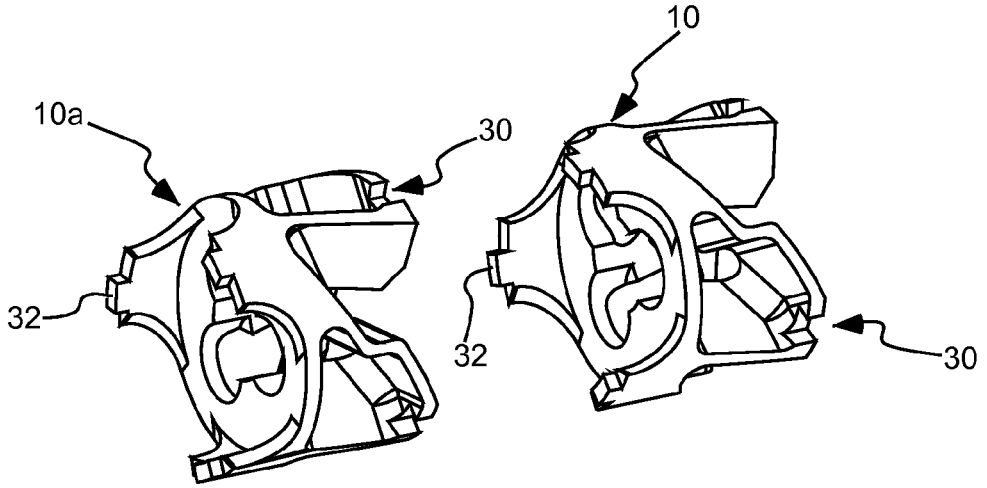
FIG. 3B is a perspective, exploded view of the pair of modules of FIG. 3A.
Figure 3C:
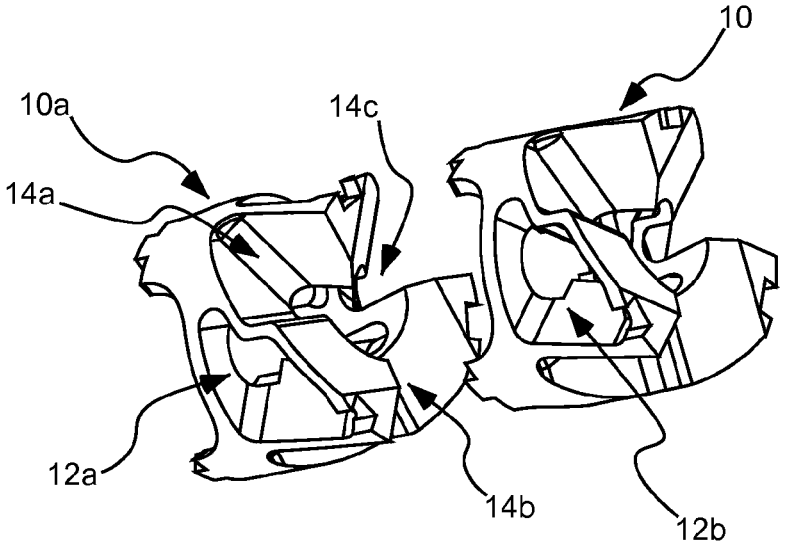
FIG. 3C is a another perspective, exploded view of the pair of modules of FIG. 3A.

While any one gas control module can include a variety of gas chambers oriented in a variety of manners, in one aspect of the invention the gas control modules are stacked (or positioned end-to-end) relative to one another. This relationship is shown by example in FIGS. 3A through 3C, where modules 10*a* and 10 are stacked relative to one another. The modules can include notches 30 and tabs 32 that engage one another to both aid in maintaining the modules in stacked alignment, and in ensuring that adjacent modules are properly rotated relative to one another. Proper alignment of adjacent modules can be important for a number of reasons. For example, in one aspect of the invention, the chambers of any one module may be complemented or completed by structure of an adjacent module. As shown in FIGS. 3A through 3C, particularly in FIG. 3A, chamber 14 is enclosed by walls 40 and 42 of module 10*a*, and by wall 44 of module 10. Thus, while each module can contain self-enclosed chambers, in this example some of the chambers are completed, or defined in their entirety, only when two modules are positioned adjacent and engaged with one another.

It will be appreciated from FIGS. 3A through 3C that chambers 14*a*, 14*b* and 14*c* (FIG. 3C) are closed off, or completed, when module 10 is stacked adjacent module 10*a*. In this manner, a relatively large open area is created into which each of the chambers 14*a*, 14*b* and 14*c* terminate. In this case, each of these chambers terminates in a common area that is also in fluid communication with the bore 16

Figure 2A:
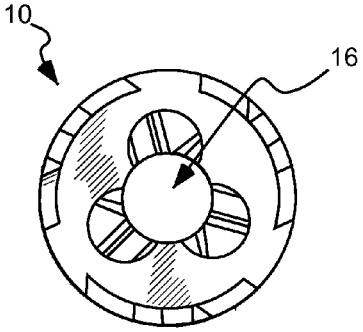
FIG. 2A is a bottom view of a firearm discharge gas flow control module in accordance with an embodiment of the invention.
Figure 2B:
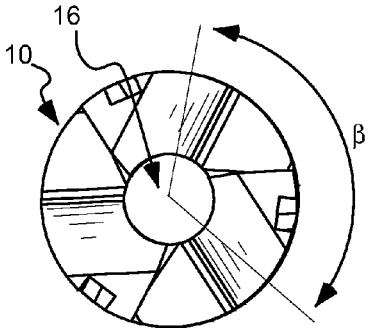
FIG. 2B is a top view of the module of FIG. 2A.
Figure 2C:
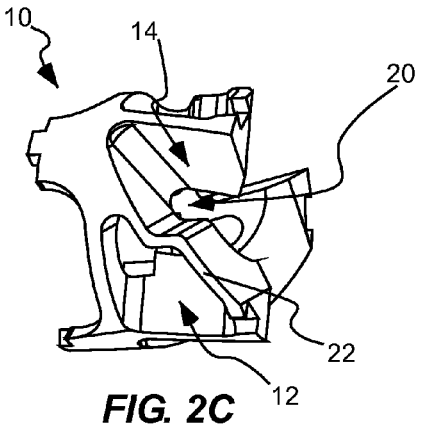
FIG. 2C is a perspective view of the module of FIG. 2A.
Figure 2D:
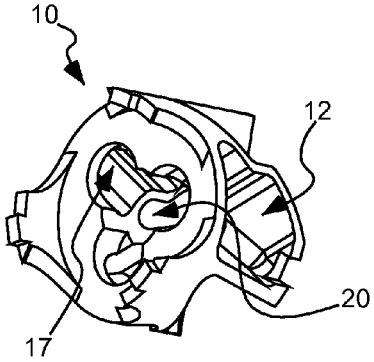
FIG. 2D is another perspective view of the module of FIG. 2A.
Figure 2E:
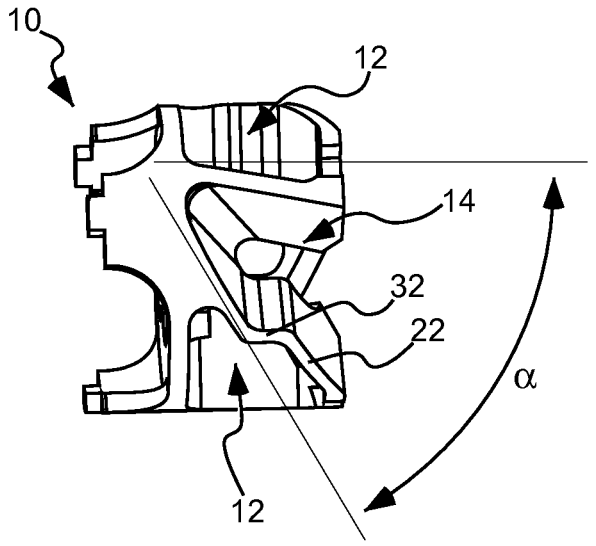
FIG. 2E is a side view of the module of FIG. 2A.

(FIGS. 2A and 2B). These chamber types can be considered "open" chambers, as they are in fluid communication with the bore at both the inlet end (e.g., the inlet port) and the terminal end.

It will be appreciated, however, that chambers 12*a* and 12*b*, shown in FIG. 3C, can be considered "closed" chambers, as they are in fluid communication with the bore at only the inlet end (e.g., the inlet port). At the opposing end of this type of chamber, the chamber simply terminates in solid structure. Note that the opening seen in FIGS. 2D and 3A of chamber type 12 will likely be covered by an outer enclosure or cover 18 (shown schematically in FIG. 4). While this outer enclosure or cover may include ports or openings that vent the chamber types 12 to the atmosphere, the chambers themselves are in fluid communication with the bore in only one location.

As discussed above, the various walls utilized in the modules can translate circumferentially as they extend longitudinally to form an angle of extension relative to a longitudinal axis of the module. This is shown schematically in FIG. 2E, where wall 22 extends at angle "a" relative to the bore of the module (and the firearm). While the angle can vary, in one example, the angle of extension is between about 30 degrees and about 75 degrees. In one embodiment, the angle of extension is about 60 degrees. Also, while not so required, in one example the wall can include a discontinuity, or "stepped" portion 32 that can increase an effective overall length of the wall 22. The stepped portion can extend substantially parallel to the bore axis of the module, while the wall is extending at a considerable angle thereto.

Figure 4:
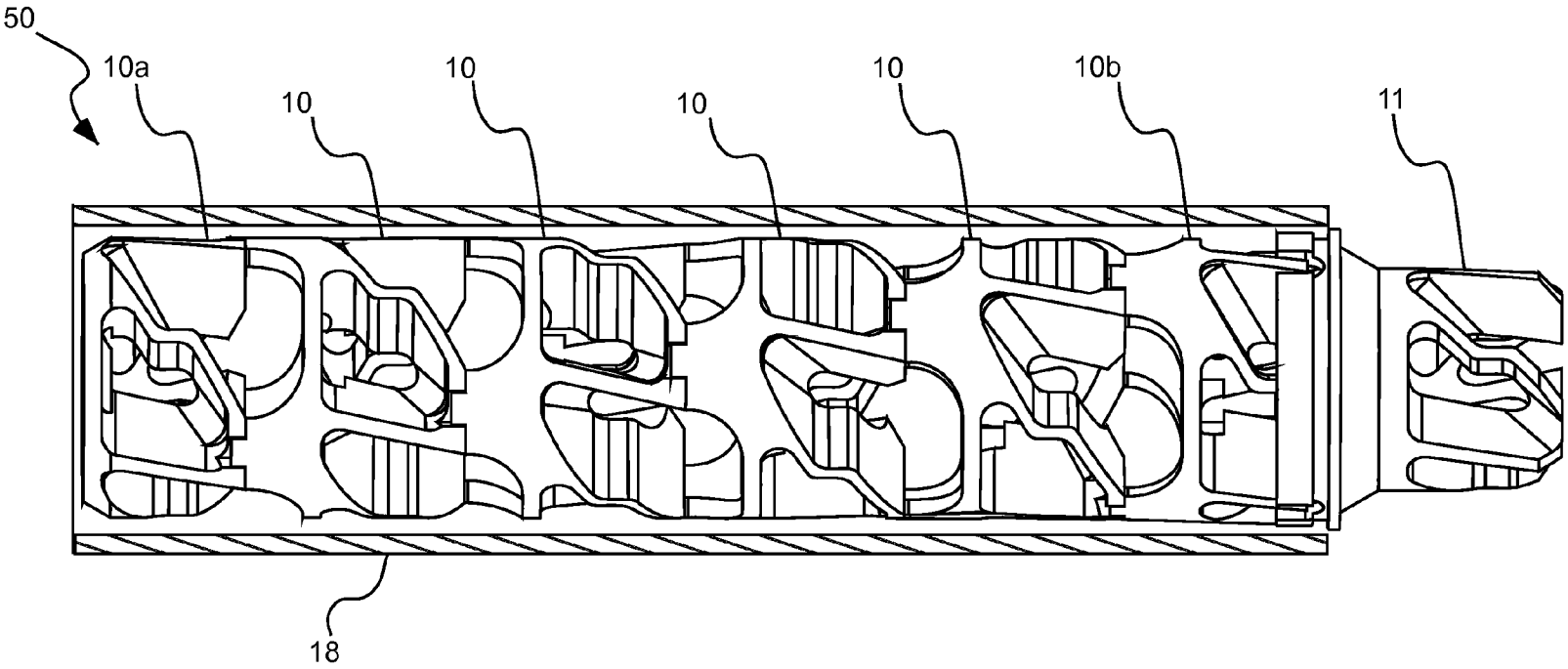
FIG. 4 is a side, partially sectioned view of a series of stacked modules circumscribed by an outer housing or cover.

As referenced above, FIG. 4 illustrates an exemplary suppressor 50 that include a series of gas control modules 10, 10*a*, 10*b*, 11, etc. The modules can each employ the technology described above to thereby collectively form the functional components of a firearms suppressor. The outer cover 18 can be configured in a variety of manners, as will be appreciated by one of ordinary skill in the art having possession of this disclosure. The outer cover be substantially solid, or can include various openings or ports that vent discharge gas to the immediately adjacent environment.

In the example shown, modules 10 can be substantially identical and can be stacked as discussed above. Module 10*a* can be configured slightly differently, as it is stacked, or paired, with another module 10 on only one side. This module 10*a* can include attachment structure (not shown) that allows the module to be coupled to the outer cover 18, or to the muzzle of a firearm. Module 10*b* can include similar attachment structure (not shown), and can also include structure that allows it to be attached to any one of flash hiders 11 and 15 that will generally extend beyond the suppressor cover, as is known in the art.

Figure 5:
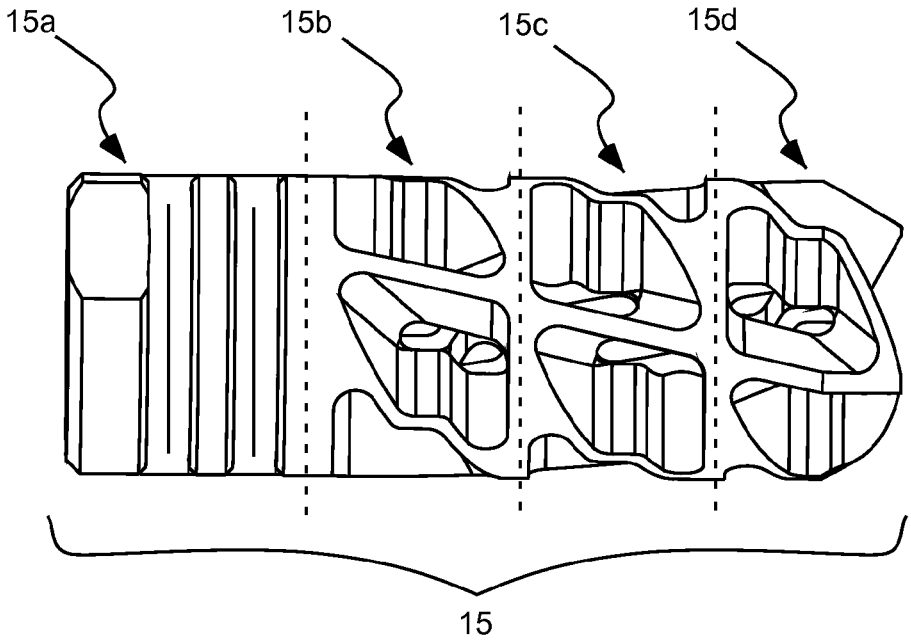
FIG. 5 is a side view of a muzzle flash hider module in accordance with another embodiment of the invention.

FIG. 5 illustrates another exemplary flash hider 15, a single continuous component with a design that can be described in sections referred to as modules, including a base module 15*a* followed by a series of flash hider modules 15*b* and 15*d* interposed by any number of intermediate modules 15*c*. Base module 15*a* includes interface structure allowing flash hider 15 to be attached to the distal end of suppressor 50, another conventional suppressor, or directly to a muzzle end of a firearm (e.g. via threads or other interlocking mechanism). In one aspect, flash hider 15 can be designed to include any number of modules 15*c* and at least one each of modules 15*b* and 15*d*. For example, the number of modules 15*c* can be one, two or three modules. In another optional aspect, the flash hider can include a single venting module which includes only base module 15*a* and a tip module 15*d* and no intervening modules. In yet another optional aspect, the flash hider can include base module 15*a*, a first vented module 15*b*, and tip module 15*d*, with no additional intermediate vented modules. Broadly, the flash hider can generally include one to five vented modules, where at least one vented module is a tip module such as module 15*d*.

Flash hider modules can each have a flash chamber design similar to the design previously described for discharge gas flow control modules. Each flash chamber is bounded by at least one wall that at least partially defines a geometry of the flash chamber. The flash chamber can extend both radially and longitudinally from the inlet port and translates circumferentially as the flash chamber extends longitudinally. In other words, a flash can enter the flash chamber through the inlet port, and expand radially outwardly from that point, as well as longitudinally from that point. The flash chamber also forces the ignited media to expand circumferentially as the flash expands longitudinally. Thus, the chamber geometry can be viewed as a "cork-screw" geometry, in which the chamber extends from the inlet port and turns circumferentially as it extends longitudinally and radially.

The boreline can be sized to accommodate any suitable caliber projectile. Non-limiting examples of such projectiles can include 0.22 LR, 5.56 mm (0.223), 7.62 mm, 9 mm, 13 mm, 7.8 mm (0.308), 10.6 mm (0.416), and 12.7 mm (0.50), although projectiles from 4 mm through 40 mm outside diameter can be readily used.

It will be appreciated that the modularity of the present technology can be advantageous in a number of manners. As the components can be relatively easily dissembled and assembled, cleaning of the system as a whole can be accomplished relatively easily and quickly. In addition, should one or more components fail, or become damaged, such a component can be easily replaced with a new component.

It is also contemplated that the various modules discussed above can be included in a firearm system. For example, in accordance with the present disclosure, a firearm system can comprise a firearm and a firearm discharge gas flow and flash control device in accordance with the embodiments already discussed.

The gas flow control modules and flash hider can be formed of a material of sufficient strength to withstand the energy created by the discharge of the firearm. Non-limiting examples of suitable materials include titanium, high impact polymers, stainless steels, aluminum, molybdenum, refractory metals, super alloys, aircraft alloys, carbon steels, composites thereof, and the like. One or more of the individual components, or portions of the components, can further include optional coatings such as, but not limited to, diamond coatings, diamond-like carbon coatings, molybdenum, tungsten, tantalum, and the like can also be used. These components can be molded, machined, deposited or formed in any suitable manner. Currently, machining of the various modules can be particularly desirable but is not required.

In a related example, and to reiterate to some degree, a method of controlling gas flow and flash discharged from a firearm can be provided. The method can include arranging one or more gas flow control modules and a flash hider on the end of a muzzle of a firearm. Each of the one or more gas flow control modules can include at least two gas chambers arranged in a circumferentially offset orientation. Additionally, the flash hider can include at least one and in some cases at least two flash chambers arranged in a circumferentially offset orientation. The firearm can be discharged to fire a projectile, thereby generating discharge gas and flash, a portion of which is thereby routed through the gas chambers of the gas flow control modules and the flash chambers of the flash hider.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. A firearm flash hider comprising:

a base module having a longitudinal boreline which is fluidly coupleable to a muzzle end of a firearm to allow a projectile to pass therethrough; and at least one vented flash control module arranged along the longitudinal boreline distal to the muzzle end, wherein the at least one vented flash control module has an inlet port adjacent a bore along the boreline operable to receive at least a portion of a flash generated by firing the projectile, and a flash chamber bounded by the inlet port and at least one wall that at least partially defines a geometry of the flash chamber, the at least one wall extending both radially and longitudinally from the inlet port and translating circumferentially as it extends longitudinally, wherein the flash chamber terminates at a circumferential angle of rotation from the inlet port, said circumferential angle of rotation being less than 180 degrees.

2. The flash hider of claim 1, wherein the at least one vented flash control module includes one tip vented module and one to three intermediate vented modules arranged in a circumferentially offset orientation, each flash chamber being operable to receive a different portion of an ignition flash generated by firing the projectile.

3. The flash hider of claim 2, wherein the at least one vented flash control module includes two intermediate vented modules.

4. The flash hider of claim 2, wherein each of the at least one vented flash control modules extend along substantially the same longitudinal space as one another.

5. The flash hider of claim 4, wherein some of the plurality of flash chambers terminate in an open area in fluid communication with the boreline.

6. The flash hider of claim 5, wherein some of the plurality of flash chambers terminate in a location fluidly isolated from the boreline.

7. The flash hider of claim 1, wherein the at least one wall translates circumferentially as it extends longitudinally to form an angle of extension of between about 30 degrees and about 75 degrees, relative to a longitudinal axis of the module.

8. The flash hider of claim 7, wherein the angle of extension is about 60 degrees.

9. The flash hider of claim 1, wherein the at least one wall includes a stepped portion extending substantially parallel to a longitudinal axis of the module, the stepped portion increasing an effective overall length of the at least one wall.

10. The flash hider of claim 1, wherein the base module includes internal threads adapted to couple to the muzzle end of the firearm.

11. The flash hider of claim 1, wherein the base module is coupleable to a firearm suppressor.

12. The flash hider of claim 1, wherein the flash hider is a single unitary piece formed of at least one of titanium, high impact polymer, stainless steel, aluminum, molybdenum, refractory metal, super alloy, aircraft alloy, carbon steel, composites thereof.

13. The flash hider of claim 1, further comprising a coating selected from the group consisting of diamond coatings, diamond-like carbon coatings, molybdenum, tungsten, tantalum, and combinations thereof.

14. The flash hider of claim 1, wherein the boreline has a nominal diameter associated with a projectile selected from the group consisting of 0.22 LR, 5.56 mm (0.223), 7.62 mm, 9 mm, 13 mm, 7.8 mm (0.308), 10.6 mm (0.416), and 12.7 mm (0.50).

15. A method of controlling flash discharged from a firearm, comprising:

attaching to the end of a muzzle of a firearm the flash hider of claim 1;

discharging the firearm to fire a projectile, thereby causing ignition and generating a flash, a portion of which is thereby routed through the flash chambers of the modules.

* * * * *